US006817121B2

(12) United States Patent
Grgic

(10) Patent No.: US 6,817,121 B2
(45) Date of Patent: Nov. 16, 2004

(54) BACKHOE FINISHING ATTACHMENT

(76) Inventor: Tomislav Grgic, 2420 Zagreb Ave., Pacific, MO (US) 63069

( * ) Notice: Subject to any disclaimer, the term of this patent is extended or adjusted under 35 U.S.C. 154(b) by 137 days.

(21) Appl. No.: 10/136,636

(22) Filed: May 2, 2002

(65) Prior Publication Data

US 2003/0204973 A1 Nov. 6, 2003

(51) Int. Cl.[7] ..... E02E 3/96
(52) U.S. Cl. ..... 37/410; 37/443
(58) Field of Search ..... 37/444, 443, 409, 37/903, 403, 404, 466, 407, 408, 410; 414/724

(56) References Cited

U.S. PATENT DOCUMENTS 2,644,251 A * 7/1953 Smith ..... 37/404
3,042,032 A 7/1962 Discenza
3,523,380 A 8/1970 Bolyard
4,009,529 A 3/1977 Johnson
4,230,435 A * 10/1980 Azevedo ..... 414/722
4,360,980 A 11/1982 Jarvis
5,456,028 A * 10/1995 Larson ..... 37/404
5,628,130 A * 5/1997 Desrochers ..... 37/444
5,918,389 A 7/1999 Hall
6,098,321 A * 8/2000 Logan ..... 37/409

* cited by examiner

*Primary Examiner*—Robert E. Pezzuto
*Assistant Examiner*—Meredith Petravick
(74) *Attorney, Agent, or Firm*—Kevin L. Klug

(57) ABSTRACT

A device and method for straightening earthen walls which allows installation of shoring and forms with minimal manual labor and risk to life. The device comprises a blade joined with two beams in a substantially U-shape all of which is attached to and works in conjunction with a backhoe bucket. The beams attach onto a backhoe bucket and allows the blade to cut earthen walls. An alternative embodiment directly attaches the substantially U-shape to the boom of a backhoe.

15 Claims, 4 Drawing Sheets

BACKHOE FINISHING ATTACHMENT

DETAILED DESCRIPTION

Figure 1:
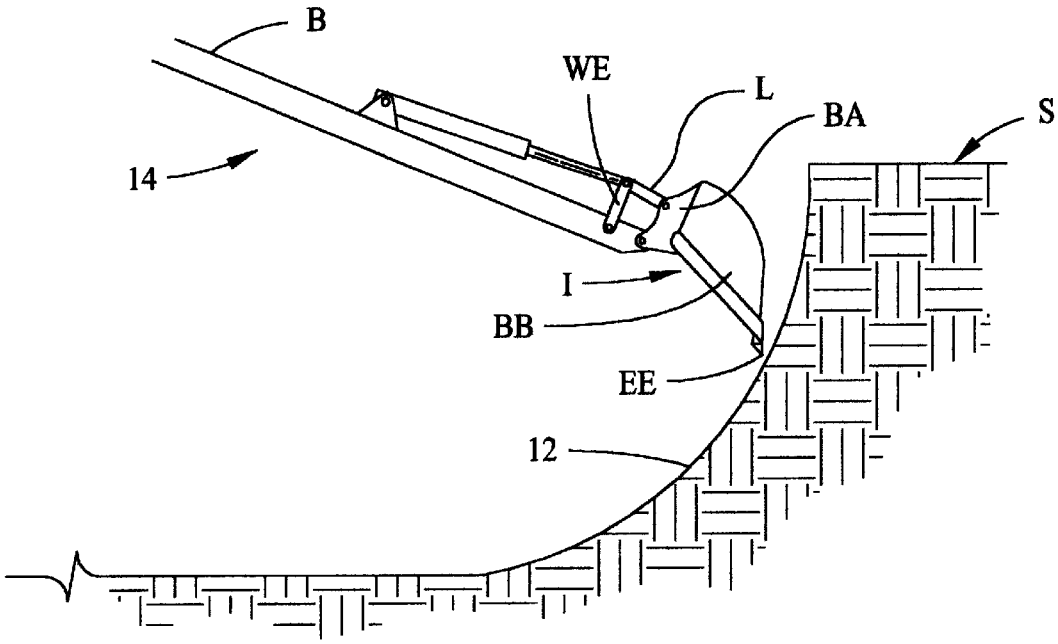

Referring now to the drawings, FIGS. 1–8 show a backhoe finishing attachment 10 and associated apparatus. Turning to FIG. 1, conventional excavating equipment like a backhoe 14 removes earth to form an excavation. By way of definition, horizontal means parallel to the surface plane S of the earth prior to excavation and vertical means perpendicular to the surface plane S of the earth prior to excavation. In addition, relating to the backhoe bucket BB, horizontal includes parallel to the aperture plane E of the backhoe bucket BB with the backhoe bucket BB rotated towards the backhoe boom B and parallel to the surface S of the earth prior to excavation. Further, relating to the backhoe bucket BB, vertical includes parallel to the left side and right side, RS of the backhoe bucket.

Typically, a backhoe 14 has an appended boom B with a detachable bucket BB at the end of the boom B. Via the cutting and holding ability of the backhoe bucket BB, a backhoe 14 removes earth and forms walls 12. Typically, the resulting walls 12 of the excavation have an inward curve towards the bottom. The curved walls 12 arise from the lowering and rotating of the boom B during digging and the fact that the earth engaging side EE of the bucket has a pivoting limit when fully opened. Since shoring and earthforms typically require straight walls 12 to attain maximum load bearing capacity, conventionally crews must manually remove the remaining wall earth to straighten the vertical excavation walls 12.

Figure 2:
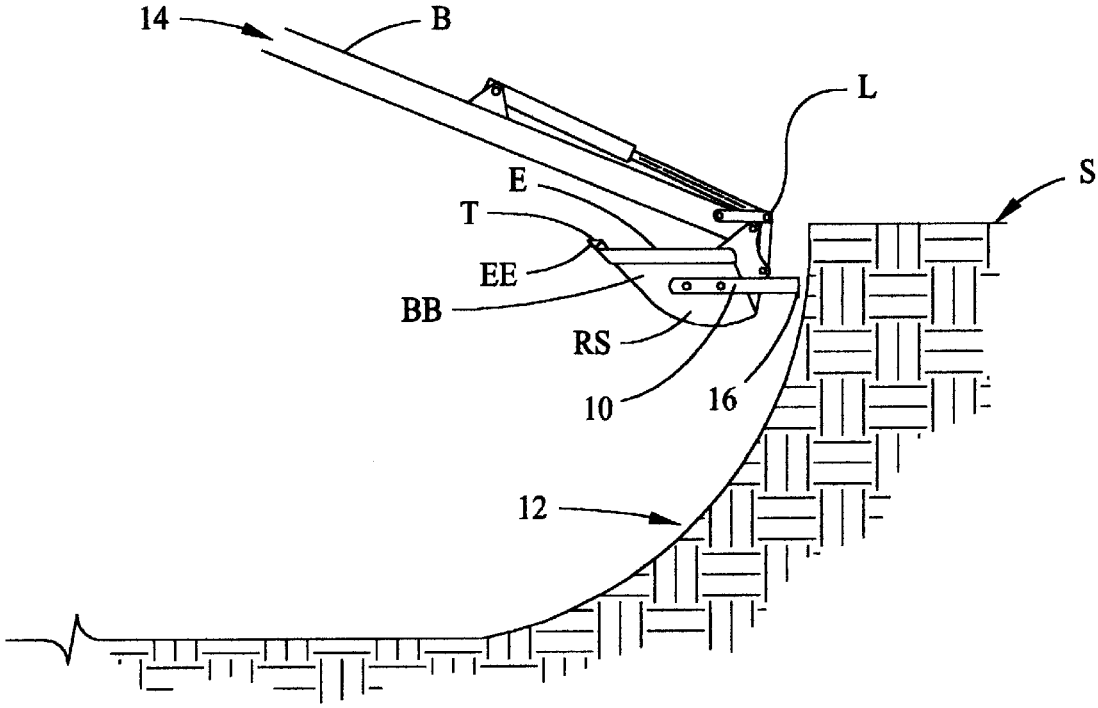

The present invention as shown in FIG. 2, remedies the curved walls 12 with the backhoe finishing attachment 10 shown attached to a backhoe bucket BB. The backhoe bucket BB typically has prongs T near its earth engaging side EE and linkage L at its boom attachment side BA. An aperture E to accept earth and provide an opening to the bucket interior I extends between the prongs T and the linkage L. Typically when not in use, the backhoe bucket BB rests upon the surface S near the excavation. FIG. 2 shows the preferred embodiment of the present invention bolted to the right side RS and left side of the backhoe bucket BB. The boom B and bucket BB are positioned to straighten the vertical wall 12 with the blade 16 of the present invention.

Figure 3:
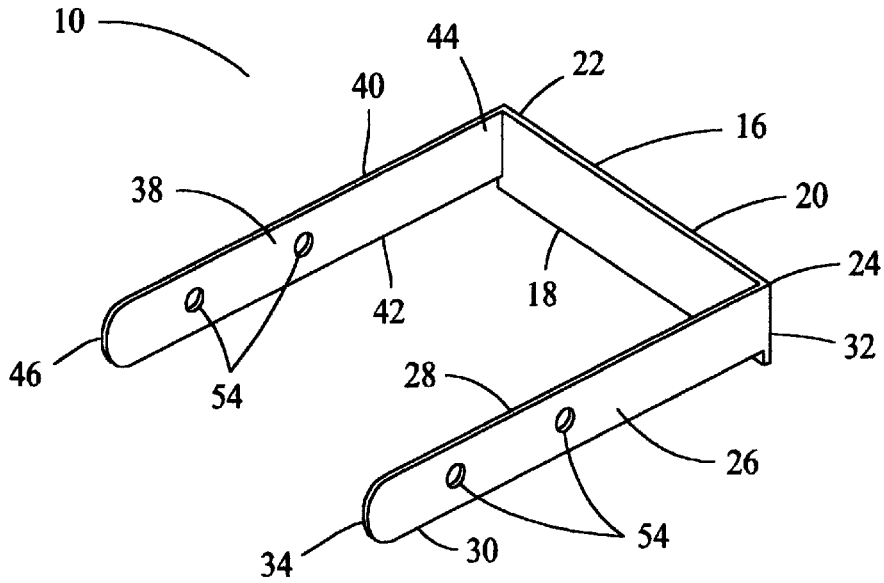
Figure 6:
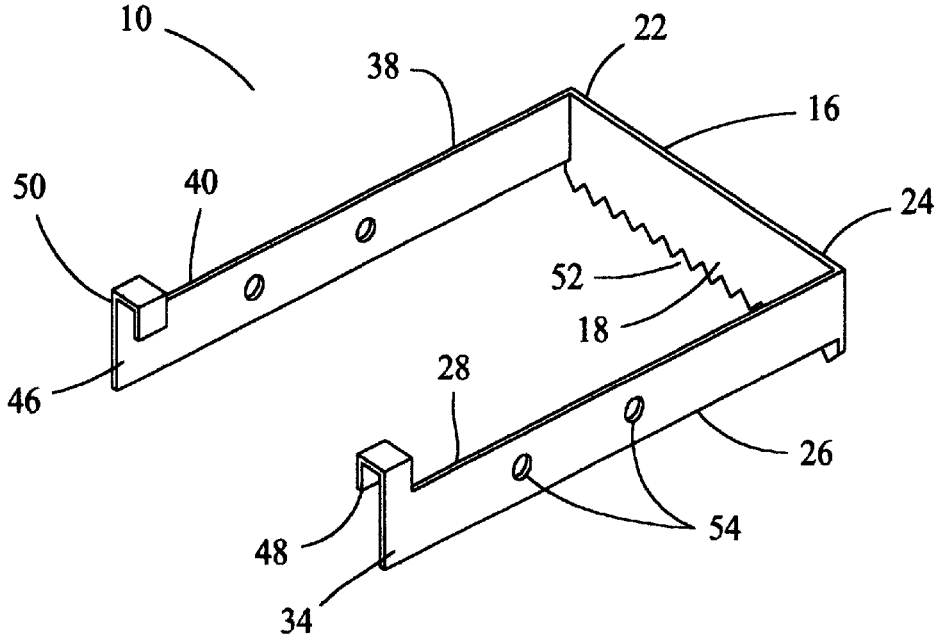

The backhoe finishing attachment 10 appears in FIG. 3 apart from the backhoe bucket BB and has a blade 16, a right beam 26, and a left beam 38 with the blade 16 attached to the two beams forming a substantially U-shape. In a preferred embodiment, the blade 16 of steel has a generally symmetric rectangular shape generally oriented vertically, a cutting edge 18, a top end 20, a left end 22, and a right end 24. The cutting edge 18 is typically the sharpened lower long edge of the blade 16. The blade 16 and the cutting edge 18 extend beneath the left and right beams 26, 38. In an alternate embodiment, the cutting edge 18 has one or more teeth 52 as shown in the embodiment of FIG. 6. The top end 20 is the upper long end of the blade 16 opposite the cutting edge 18. Looking between the beams 26, 38 towards the blade 16, the short end of the blade 16 towards the left is the left end 22 and opposite the left end 22 is the right end 24 of the blade 16. In a preferred embodiment, the left end 22 of the blade 16 is joined to the left beam 38 and the right end 24 of the blade 16 is joined to the right beam 26.

Again looking towards the blade 16, the beam towards the left is the left beam 38 and opposite the left beam 38 is the right beam 26. In a preferred embodiment, the left beam 38 and the right beam 26 have a generally symmetric rectangular shape of substantially greater length than width, a top end 40, 28 and a bottom end 42, 30 opposite said top end 40, 28, respectively. Alternative embodiments may incorporate any structurally sound cross section. The left beam 38 has a front end 44 at the blade 16 and a rear end 46 away from the blade 16. The right beam 26 has a front end 32 at the blade 16 and a rear end 34 away from the blade 16. In the preferred embodiment, the blade 16 is welded to the beams 26, 38 but may be connected with any conventional method of metal joining in alternative embodiments, including but not limited to bolts and pins. In a preferred embodiment, the front end 44 of each the left beam 38 and right beam 26 is welded to the blade 16.

In a preferred embodiment, each the left beam 38 and the right beam 26 have one or more regularly spaced holes 54 to attach each beam 38, 26 to the left side and right side RS of the backhoe bucket BB respectively. In the preferred embodiment, the spacing of the holes 54 allows use of hand tools to tighten mechanical fasteners such as bolts or pins and further deters bending of the beam 38. Alternate embodiments, press the backhoe finishing attachment 10 into shape from a single piece of steel or other structurally sound material.

In an alternative embodiment, the blade 16 has a substantially semi-circular shape akin to a hand shovel oriented vertically, a cutting edge 18, a top end 20, a left end 22, and a right end 24. The cutting edge 18 is typically the sharpened lower curved edge of the blade 16 although the top end 20 may be utilized for cutting when required. In the identified alternative embodiment, the blade 16 and the cutting edge 18 extend beneath the left and right beams 26, 38. The top end 20 is the substantially straight long edge of the blade 16 opposite the cutting edge 18. In a preferred embodiment, the left end 22 of the blade 16 is welded to the left beam 38 and the right end 24 of the blade 16 is welded to the right beam 26.

Figure 4:
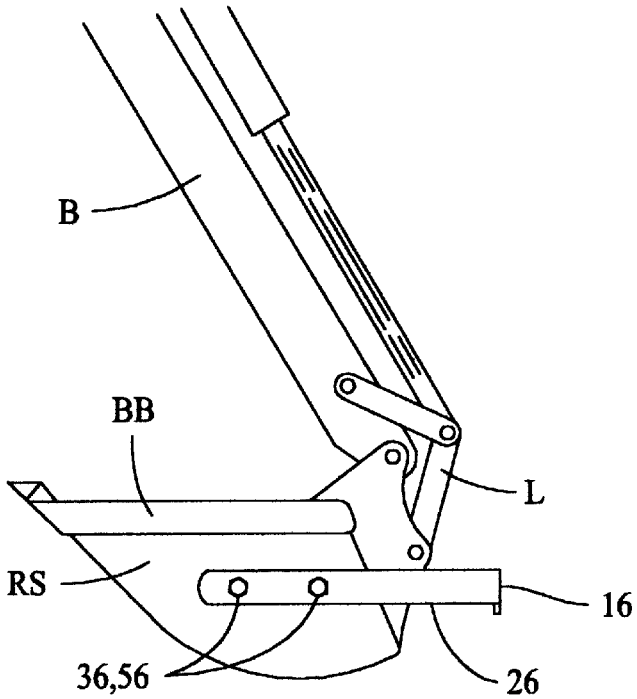

FIG. 4 illustrates the backhoe finishing attachment 10 installed on a backhoe bucket BB. The backhoe finishing attachment 10 typically fits outside the backhoe bucket BB and along the sides including the left side and RS of the backhoe bucket BB. The right beam 26 positions the blade 16 away from the linkage L and ahead of the backhoe bucket BB. The right beam 26 extends towards the prongs T or earth engaging side EE of the backhoe bucket BB along the right side RS of the backhoe bucket BB. Matching the holes 54 in the right beam 26 to the holes 54 in the right side RS of the backhoe bucket BB, the right beam 26 is bolted by one or more bolts 56 to the right side RS of the backhoe bucket BB. As the left beam 38 and the left side of the backhoe bucket BB are symmetric to the right beam 26 and the right side RS of the backhoe bucket BB, the left beam 38 bolts to the left side of the backhoe bucket BB as described for the right beam 26. In alternative embodiments, the left beam 38 and the right beam 26 may be welded to their respective sides of the backhoe bucket BB. In further alternative embodiments, the left beam 38 and the right beam 26 may be joined to the their respective sides of the backhoe bucket BB by an adhesive or with a hook and latching mechanism. In a still further alternative embodiment, the left beam 38 and the right beam 26 join their respective sides, the left side and RS of the backhoe bucket BB through magnetic attraction.

Figure 5:
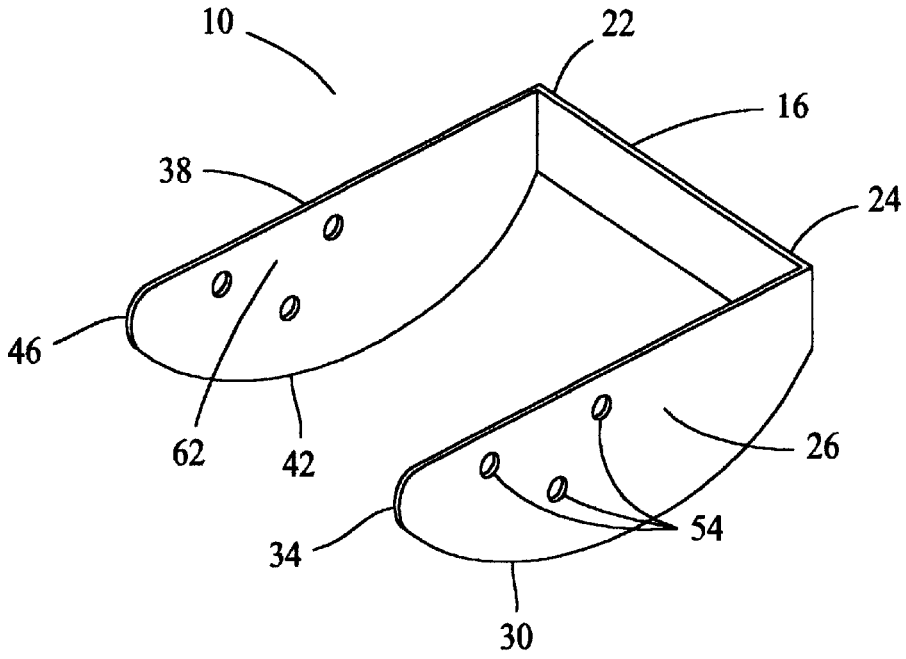

FIG. 5 shows an alternative embodiment for the backhoe finishing attachment 10. Replacing the beams 26, 38 described in FIGS. 3 & 4 are plates of steel which connect the blade 16 to the backhoe bucket BB. In a preferred form of this alternative embodiment, the right beam 26 and the left beam 38 have a straight end on the top that runs from the left and right ends 22, 24 of the blade 16 across the length of the right beam 26 and the left beam 38. Furthermore, the right beam 26 and the left beam 38 each preferably contain three or more holes 54 with at least one hole 54 offset from the remaining holes 54, but may contain one or more holes and still function. The preferred generally triangular arrangement 62 of the holes 54 in each beam 26, 38 provides a shear and moment resisting connection of the beams 26, 38 to the backhoe bucket BB. The preferably curved bottom end 30 of the right beam 26 and curved bottom end 42 of the left beam 38 runs from the left and right ends 22, 24 of the blade 16 beneath the holes 54 and then to the rear ends 34, 46 of the right beam 26 and the left beam 38 respectively. In further alternative embodiments, other plate forms connect the blade 16 to the backhoe bucket BB without departing from the spirit of the present art. Akin to FIG. 4, the right beam 26 and the left beam 38 may join their respective sides RS, and the left side of the backhoe bucket BB by welds, adhesives, or magnetism or other conventional mechanical fastening methods.

FIG. 6 is an alternate embodiment derived from FIG. 3. In this alternative embodiment, the cutting edge 18 of the blade 16 has a plurality of teeth 52 arrayed in a regular pattern. The teeth 52 generally point downward during use to assist in the earth cutting operation of the backhoe finishing attachment 10. Further alternative embodiments may utilize one or more teeth 52 or not utilize teeth at all. The right beam 26 and the left beam 38 extend from the left and right ends 22, 24 of the blade 16 rearward. In the preferred form, each beam 26,38 has one or more holes 54 for bolts 56 to secure the beams 26, 38 to the backhoe bucket BB. At the rear ends 34, 46, the beams 26, 38 have clips 48, 50 on the top edges 28, 40. The right clip 48 extends upward from the right beam 26 then bends inwards, between the beams 26, 38, and downward into the bucket interior I at the intersection of the aperture E and bucket right side RS. Symmetric to the right clip 48, the left clip 50 extends upward from the left beam 38 then bends inwards, between the beams 26, 38, and downward into the bucket interior I at the intersection of the aperture E and bucket left side. During assembly, the right clip 48 and the left clip 50 assist the crew during installation of the backhoe finishing attachment 10. In front of the linkage L, a crew would place the right clip 48 and the left clip 50 on the top of both sides RS, and the left side of the backhoe bucket BB near the intersection of the sides RS, and the left side and the aperture E. The crew would then push the blade 16 until the holes 54 in the beams 26, 38 aligned with the holes 54 in the sides of the backhoe bucket BB.

Figure 7:
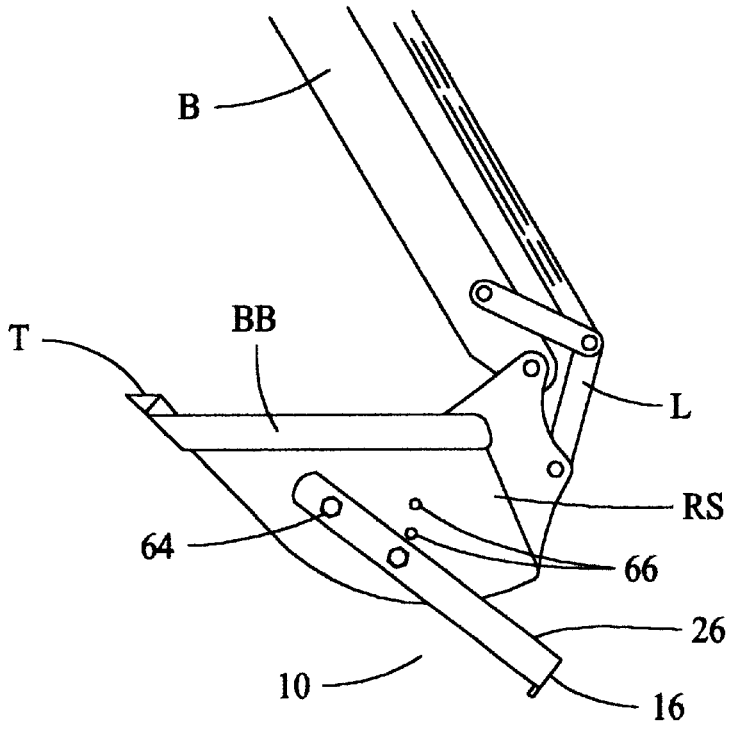

FIG. 7 provides a still further embodiment of the backhoe finishing attachment 10 which minimizes damage risk to the boom B and linkage L. In this embodiment, the sides RS, and the left side of the backhoe bucket BB have a pivot hole 64 and two or more mounting holes 66 arranged in an arc. In the preferred form, the right beam 26 and the left beam 38 of the backhoe finishing attachment 10 bolt to the pivot hole 64 with the holes 54 in the beams 26, 38 and to a mounting hole 66 with the remaining holes 54 in the beams 26, 38. The crew chooses at which downward angle to install the right beam 26 and the left beam 38. Installed at an angle, the backhoe finishing attachment 10 has the blade 16 farther away from the boom B. This positioning reduces the risk of the blade 16 damaging the boom B upon opening of the backhoe bucket BB.

Figure 8:
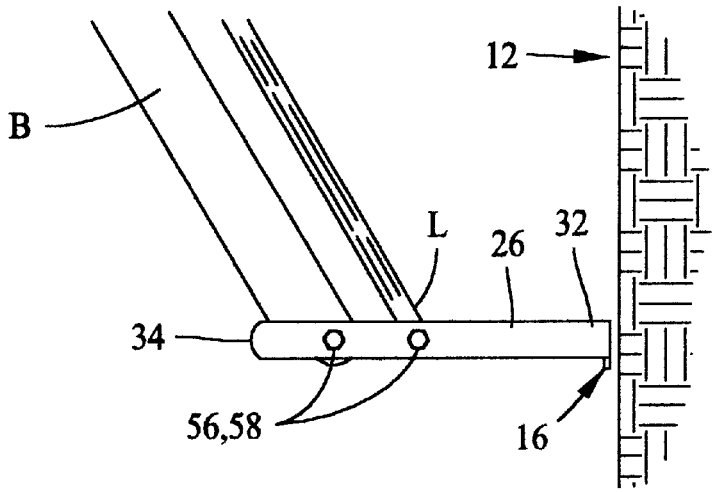

FIG. 8 shows a still further alternative embodiment with the backhoe finishing attachment 10 connecting directly to the boom B and the linkage L in the absence of a backhoe bucket BB near the working end WE of the boom B and linkage L. In this form, the backhoe finishing attachment 10 also has a blade 16, left beam 38, and a right beam 26 as described for prior embodiments. The left beam 38 has one or more regularly spaced holes 54 to attach the left beam 38 to the left side of the boom B and the linkage L. The spacing of the holes 54 matches the distance between the boom B and the linkage L. The right beam 26 also has one or more regularly spaced holes 54 to attach the right beam 26 to the right side RS of the boom B and the linkage L. The spacing of the holes 54 also matches the distance between the boom B and the linkage L. As in prior embodiments, the holes 54 of the right beam 26 may match those of the left beam 38 for ease of manufacturing and installation of the device. The left beam 38 positions the blade 16 away from the linkage L and away from the boom B. The left beam 38 extends from the blade 16 to the linkage L and then to the boom B along the left side. Matching the holes 54 in the left beam 38 to the linkage L and to the boom B, the left beam 38 is joined by two bolts 56 to the left side of the linkage L and the boom B. As the left beam 38 and the left side of the boom B and linkage L are symmetric to the right beam 26 and the right side RS of the boom B and linkage L, the right beam 26 bolts to the right side RS of the boom B and linkage L as described for the left beam 38.

In operation, for all embodiments, the excavation crew moves or removes earth to the desired depth, footprint, and position. The crew then closes or removes the backhoe bucket BB of the backhoe and rests the backhoe bucket BB on a surface. The crewmen then lift the backhoe finishing attachment 10 and attach it onto the bucket BB or boom B as aforesaid, depending upon the embodiment. Once the backhoe finishing attachment 10 is connected, the crew moves the boom B and the backhoe bucket BB so that the blade 16 contacts the earth at the desired wall 12 location. When the backhoe boom B and bucket BB is jointly lowered or raised by an experienced operator, the blade 16 proceeds in a vertical line, removing earth at the desired wall 12 location. After the crew cuts the wall 12 vertically straight with the blade 16, the crewmen remove the backhoe finishing attachment 10 by reversing the installation steps aforementioned. The crew then returns the backhoe bucket BB into the excavation to remove the cuttings at the base of the straight wall 12. The crew then installs shoring or formwork per construction plans and specifications.

From the foregoing description, those skilled in the art will appreciate that all objects of the present invention are realized. A device and method to plumb earthen walls has been shown and described. This invention provides a device that firmly attaches to a conventional backhoe or backhoe bucket to cut earth without specialty tools, specialty labor, risk to life, or time consuming operations.

Having described the invention in detail, those skilled in the art will appreciate that modifications may be made to the invention without departing from its spirit. Therefore, it is not intended that the scope of the invention be limited to the specific embodiments illustrated and described. Rather it is intended that the scope of this invention be determined by the appended claims and their equivalents.

I claim:

1. A backhoe finishing attachment in combination with a backhoe comprising:

a backhoe bucket having a right side, a left side, an interior, an exterior, an earth engaging side, and a boom attachment side having a linkage; and a substantially U-shaped form having a blade, a right beam, and a left beam, said blade having a cutting edge, a top end opposite said cutting edge, a left end and a right end, said right beam having a top end, a bottom end, a front end substantially attached near said blade right end whereby said top end of said blade is substantially closer to said top end of said right beam than said bottom end of said right beam, and a rear end opposite said front end, said left beam having a top end, a bottom end, a front end substantially attached near said blade left end whereby said top end of said blade is substantially closer to said top end of said left beam than said bottom end of said left beam, and a rear end opposite said front end; and said left beam and said right beam having means to attach said left beam to said left side of said backhoe bucket and said right beam to said right side of said backhoe bucket; and said blade positioned by said beams away from said linkage and ahead of said backhoe bucket, whereby said blade is substantially opposite said earth engaging side.

2. The backhoe finishing attachment in combination with a backhoe of claim 1, whereby:

said right beam and said left beam each have a substantially rectangular cross sectional shape in the plane perpendicular to the axis from each of said respective front and rear ends.

3. The backhoe finishing attachment in combination with a backhoe of claim 1, whereby:

said right beam and said left beam each having a substantially semi-circular bottom end extending from substantially near said front end of each said beams to substantially near said rear end of each said beams.

4. A backhoe finishing attachment in combination with a backhoe of claim 1, further comprising:

a right clip attached substantially near said top end of said right beam and extending into said interior of said bucket; and a left clip attached substantially near said top edge of said left beam and extending into said interior of said bucket.

5. The backhoe finishing attachment in combination with a backhoe of claim 1 wherein the cutting edge of the blade is sharpened.

6. The backhoe finishing attachment in combination with a backhoe of claim 1 wherein the cutting edge of the blade has one or more teeth.

7. The backhoe finishing attachment in combination with a backhoe of claim 1 wherein said means to attach said left beam to said left side of said backhoe bucket and said right beam to said right side of said backhoe bucket comprises:

one or more bolts installed through one or more holes within said beams and said bucket.

8. The backhoe finishing attachment in combination with a backhoe in claim 1 wherein said means to attach said left beam to said left side of said backhoe bucket and said right beam to said right side of said backhoe bucket comprises:

one or more quick release pins installed through one or more holes within said beams and said bucket.

9. The backhoe finishing attachment in combination with a backhoe of claim 1 wherein said means to attach said left beam to said left side of said backhoe bucket and said right beam to said right side of said backhoe bucket comprises:

one or more welds between said beams and said bucket.

10. The backhoe finishing attachment in combination with a backhoe of claim 1 wherein said means to attach said left beam to said left side of said backhoe bucket and said right beam to said right side of said backhoe bucket comprises:

two or more holes in each of said right and left beams; and two or more holes in each of said right and left side of said bucket which align respectively with said holes in said right and left beams; and two or more bolts, said bolts installed in each of said holes in said beams and said holes in said bucket.

11. The backhoe finishing attachment in combination with a backhoe of claim 1 wherein said means to attach said left beam to said left side of said backhoe bucket and said right beam to said right side of said backhoe bucket comprises:

said right beam and said left beam each having two or more holes capable of aligning with two or more holes on the right side and the left side of said bucket respectively, said backhoe bucket holes further defined by a pivot hole and two or more mounting holes in each of said right side and said left side of said backhoe bucket, said mounting holes positioned along an arc relative to said pivot hole; and four or more bolts, said bolts installed in each of said holes in said beams and said holes aligning therewith in said bucket, whereby one of each of said right beam and said left beam holes aligns with, attaches with, and pivots relative to said pivot holes in said bucket and is further secured with and onto said bucket with said bolts through said mounting holes thereby providing at least two angles of mounting relative to said bucket.

12. A backhoe finishing attachment comprising:

a backhoe having a boom and a linkage each having one or more holes at a respective working end of each; and a substantially U-shaped form having a blade, a right beam, and a left beam, said blade having a cutting edge, a top end opposite said cutting edge, a left end and a right end, said right beam, having a top end, a bottom end, a front end attached to said blade between said left end and said right end of said blade, a rear end opposite said front end, and two or more holes spaced along the length of said right beam and capable of aligning with said holes in said boom and linkage, said left beam, having a top end, a bottom end, a front end attached to said blade between said left end and said right end of said blade, a rear end opposite said front end, and two or more holes spaced along the length of said left beam and capable of aligning with said holes in said boom and linkage; and one or more bolts installed through said holes of said left beam and said right beam and through said boom and said linkage holes thereby connecting said backhoe finishing attachment to said boom and said linkage; and said blade oriented substantially vertically whereby vertical is perpendicular to the surface plane of a earth prior to excavation, thereby allowing an operator to lower or raise said boom and proceed in a substantially vertical line and remove said earth at a desired wall location.

13. A method to straighten earthen walls, the steps comprising:

creating an earthen wall using a conventional backhoe bucket, said bucket having an inside, an outside, a right side, a left side, an earth engaging side and a boom attachment side having a linkage; and resting said backhoe bucket upon a surface; and forming a substantially U shaped member having a blade, a right beam, and a left beam; and sliding said right beam and said left beam from said boom attachment side along said outside of said bucket; and securing said right beam onto said right side of said bucket and said left beam onto said left side of said bucket whereby said blade extends from said bucket away from said linkage and ahead of said backhoe bucket, thereby positioning said blade substantially opposite said earth engaging side; and positioning said bucket so that said blade contacts said earthen wall at a desired location; and moving said bucket in a substantially straight vertical path whereby said blade cuts said earthen wall.

14. The method to straighten earthen walls of claim 13 wherein the step of securing said right beam and said left beam onto said bucket comprises:

forming one or more aligned holes in said left beam and said left side said bucket; and forming one or more aligned holes in said right beam and said right side of said bucket; and placing one or more bolts through each of said holes on said left side and said right side.

15. The method to straighten earthen walls of claim 13 wherein the step of securing said right beam and said left beam onto said bucket comprises:

welding one or more of said beams onto said bucket.

* * * * *